US010737704B2

(12) United States Patent
Schertler et al.

(10) Patent No.: US 10,737,704 B2
(45) Date of Patent: Aug. 11, 2020

(54) CABLE CAR SYSTEM

(71) Applicant: INNOVA PATENT GMBH, Wolfurt (AT)

(72) Inventors: Kurt Schertler, Wolfurt (AT); Johannes Moritzhuber, Hard (AT)

(73) Assignee: Innova Patent GmbH, Wolfurt (AT)

( * ) Notice: Subject to any disclaimer, the term of this patent is extended or adjusted under 35 U.S.C. 154(b) by 409 days.

(21) Appl. No.: 15/306,250

(22) PCT Filed: May 7, 2015

(86) PCT No.: PCT/AT2015/000066
§ 371 (c)(1),
(2) Date: Oct. 24, 2016

(87) PCT Pub. No.: WO2015/196221
PCT Pub. Date: Dec. 30, 2015

(65) Prior Publication Data

US 2017/0043792 A1 Feb. 16, 2017

(30) Foreign Application Priority Data

Jun. 26, 2014 (AT) ..... A 509/2014

(51) Int. Cl.
*B61B 12/00* (2006.01)
*B61B 7/00* (2006.01)
(Continued)

(52) U.S. Cl.
CPC ..... *B61B 12/00* (2013.01); *B61B 7/00* (2013.01); *B61B 7/04* (2013.01); *B61B 12/002* (2013.01);
(Continued)

(58) Field of Classification Search
CPC ..... B61B 3/00; B61B 12/00; B61B 12/002; B61B 12/028; B61B 7/00; B61B 12/02; B61B 7/04
(Continued)

(56) References Cited

U.S. PATENT DOCUMENTS 3,625,158 A * 12/1971 Lorenz ..... B61B 13/04 104/110
5,236,338 A * 8/1993 Pfannkuche ..... H02G 5/04 191/23 A
(Continued)

FOREIGN PATENT DOCUMENTS

CH 701450 A1 1/2011
DE 2942839 A1 5/1981
(Continued)

*Primary Examiner* — Scott A Browne
(74) *Attorney, Agent, or Firm* — Laurence A. Greenberg; Werner H. Stemer; Ralph E. Locher

(57) ABSTRACT

A cable car system has vehicles which are coupled to a conveying cable between stations. The vehicles are decoupled from the conveying cable in the stations and are moved through the stations along guide rails. The vehicles are formed with current collectors and the stations have associated power rails. In at least one of the vehicles there is located a circuit with at least one electrical load which is supplied with electrical energy via the current collector and the power rails. At least one second circuit with at least one further electrical load is located in at least one vehicle. The second circuit is supplied with electrical energy via a single further current collector and a power rail assigned thereto. The two circuits are connected to a common current collector to which a single power rail is assigned.

7 Claims, 4 Drawing Sheets

(51) Int. Cl.

| | |
|---|---|
| ***B61B 12/02*** | (2006.01) |
| ***B61B 7/04*** | (2006.01) |
| *B61B 1/00* | (2006.01) |
| *B61B 3/00* | (2006.01) |

(52) U.S. Cl.
CPC ..... *B61B 12/02* (2013.01); *B61B 1/00* (2013.01); *B61B 3/00* (2013.01)

(58) Field of Classification Search
USPC ..... 104/93
See application file for complete search history.

(56) References Cited

U.S. PATENT DOCUMENTS

| | | | | |
|---|---|---|---|---|
| 6,192,803 | B1 * | 2/2001 | Nishino | B61C 13/04 104/249 |
| 6,264,017 | B1 * | 7/2001 | Evans | B60L 5/36 104/93 |
| 7,002,319 | B2 | 2/2006 | Hinteregger | |
| 7,389,729 | B2 * | 6/2008 | Hinteregger | B60L 8/003 104/173.1 |
| 8,910,578 | B2 | 12/2014 | Gubler | |
| 2005/0016415 | A1 * | 1/2005 | Music | A47C 7/748 105/149.2 |
| 2005/0139113 | A1 * | 6/2005 | Kling | B61B 3/00 104/93 |
| 2006/0060104 | A1 | 3/2006 | Hinteregger | |
| 2006/0071862 | A1 * | 4/2006 | Aisenbrey | H01B 1/22 343/700 MS |
| 2008/0276826 | A1 | 11/2008 | Erhart | |
| 2012/0103225 | A1 * | 5/2012 | Gubler | B61B 12/002 104/112 |

FOREIGN PATENT DOCUMENTS

| | | | |
|---|---|---|---|
| EP | 1495935 | A1 | 1/2005 |
| EP | 1396407 | B1 | 7/2005 |
| EP | 1764279 | A1 | 3/2007 |
| EP | 1992539 | A1 | 11/2008 |
| EP | 2578466 | A1 | 4/2013 |
| WO | 2011003812 | A2 | 1/2011 |

* cited by examiner

CABLE CAR SYSTEM

BACKGROUND OF THE INVENTION

Field of the Invention

The present invention relates to a cable car system having at least two stations and having at least one conveying cable, or rather having at least one suspension cable and at least one hauling cable assigned thereto, and also having vehicles which can be coupled to the conveying cable, or rather to the hauling cable and moved along the suspension cable, which vehicles are decoupled from the conveying cable or from the hauling cable in the stations and are moved through the stations along guide rails, wherein the vehicles are formed with current collectors to which power rails located in the stations are assigned, and wherein in at least one of the vehicles there is located a circuit with at least one electrical load which is supplied with electrical energy via the current collector and the power rails.

It is known from EP 1396407 B1 to supply electrical energy to vehicles of cable car systems which are provided with at least one load and with a battery, in such a way that the vehicles are formed with two current collectors and power rails connected to a power source are assigned to the current collectors in the stations. As the vehicles travel through the stations, the batteries and loads located therein can thus be supplied with electrical energy via the power rails and the current collectors.

Here, however, it should be taken into consideration that the power rails are arranged fixedly in the stations, whereas the vehicles, such as the chairs or the vehicle cabins, pivot transversely to the direction of travel on account of their movement through the stations. In order to ensure a contact between the current collectors located on the vehicles and the power rails that meets the requirements, the current collectors must be located at a point of the vehicles that is located opposite the power rails in a constant relative position as the vehicles move through the stations.

The vehicles of cable car systems are formed with coupling devices, by means of which they can be coupled to a conveying cable or to a hauling cable of the cable car system. The vehicles are decoupled from the conveying cable or from the hauling cable in the stations. The coupling devices are also formed with a running gear, which is moved along guide rails in the stations, in which the vehicles are decoupled from the conveying cable or from the hauling cable.

Due to the guidance of the coupling device by means of the running gear along the guide rails located in the stations, the coupling device is located in stable positions opposite the power rails during its movement through the stations. Here, however, there is the difficulty that there is only a very small amount of space available on the coupling device for the arrangement of the current collectors.

According to EP 1396407 B1, two power rails and two current collectors assigned thereto are provided, and a circuit for feeding a battery is located in the vehicle and supplies a seat heater located in the vehicle.

BRIEF SUMMARY OF THE INVENTION

The object of the present invention is to make it possible to provide at least one further circuit, i.e. at least two circuits, in a vehicle of a cable car system, to which different loads can be connected.

This object is achieved in accordance with the invention in that at least one second circuit with at least one further electrical load is located in at least one vehicle, which second circuit is supplied with electrical energy via a single further current collector and a power rail assigned thereto, wherein the at least two circuits are connected to a common current collector to which a single power rail is assigned.

The present invention is based on the finding that, for the arrangement of a plurality of circuits located in a vehicle, it is not necessary to provide a pair of current collectors and power rails assigned to each other for each circuit, but instead it is sufficient to provide each of the individual circuits with its own feed line, whereas the individual circuits can be connected to a common return line. Only a single further current collector and a power rail assigned thereto are thus necessary for each further circuit, said power rail being guided to the power source assigned to this circuit. The space required for this further current collector is available on the coupling device.

The common power rail assigned to the circuits is preferably grounded.

In accordance with a preferred embodiment at least one of the circuits is fed with direct current and at least one of the further circuits is fed with alternating current. At least one battery can also be located in at least one of the circuits. In addition, at least one battery which is arranged downstream of a rectifier can be located in the at least one circuit fed with alternating current.

BRIEF DESCRIPTION OF THE SEVERAL VIEWS OF THE DRAWING

The subject matter of the invention will be explained hereinafter on the basis of an exemplary embodiment illustrated in the drawing, in which.

DESCRIPTION OF THE INVENTION

Figure 1:
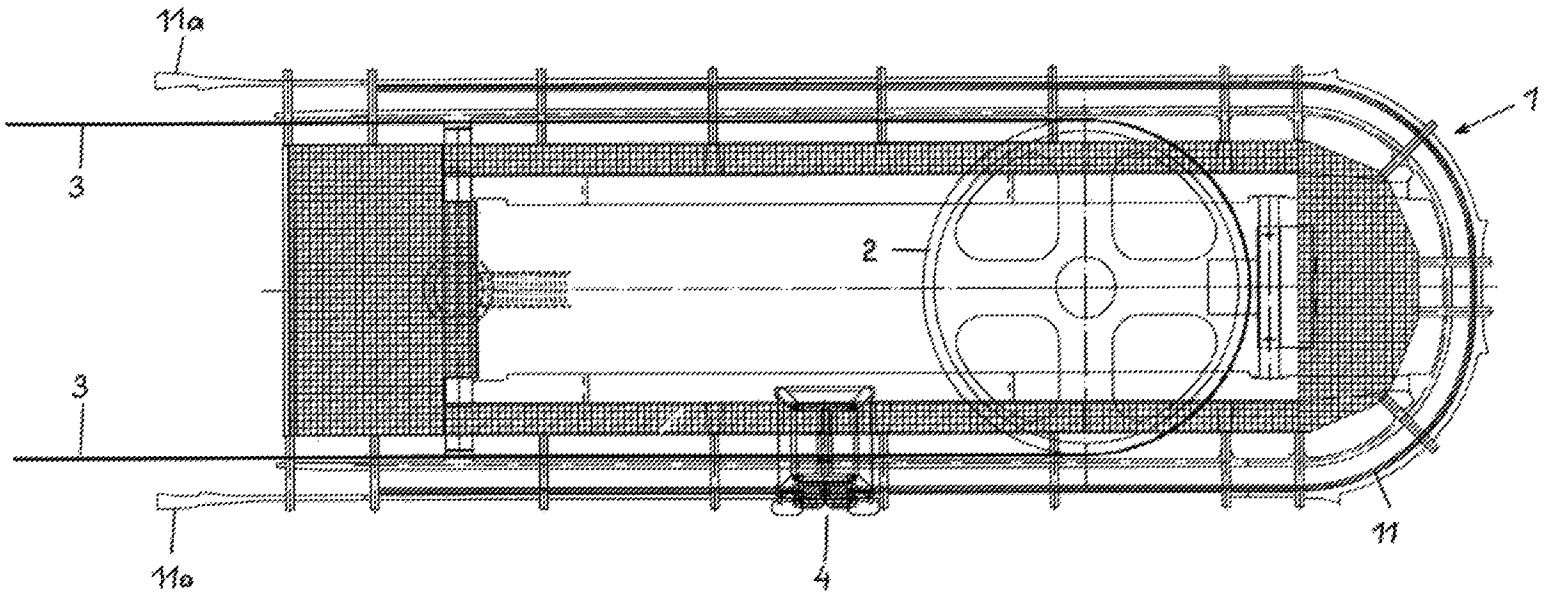
FIG. 1 shows an end station of a cable car system, in a plan view.

The end station of a cable car system illustrated in FIG. 1 has a supporting structure 1, on which there is mounted a deflection pulley 2 for a conveying cable 3 of the cable car system. The conveying cable 3 is moved for example at a speed of from 7 m/sec to 10 m/sec. Vehicle cabins 4 are coupled to the conveying cable 3 outside the cable car stations. In the stations the vehicle cabins 4 decoupled from the conveying cable 3 are moved through the stations along a guide rail 11 by means of control tires. A first group of control tires acts as delay tires, by means of which the speed of the vehicle cabins 4 is slowed for example to 0.3 m/sec. The vehicle cabins 4 are moved on into the stations at this low speed by means of a second group of control tires, wherein passengers enter or alight said vehicle cabins. A third group of control tires acts as acceleration tires, by means of which the speed of the vehicle cabins 4 is increased to the speed of the conveying cable 3, whereupon the vehicle cabins are coupled again to the conveying cable 3. The guide rail 11 is formed with intake funnels 11*a* at both of its ends.

Figure 2:
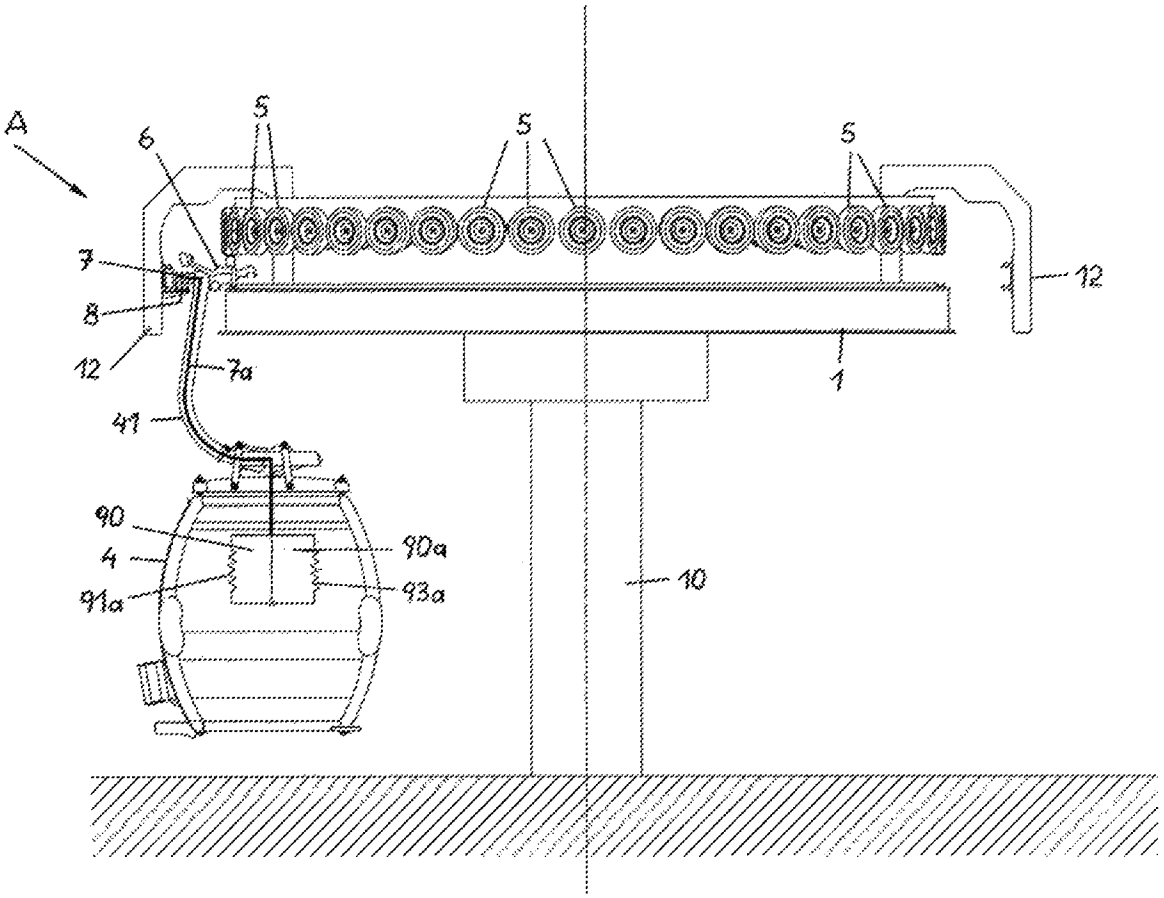
FIG. 2 shows the end station according to FIG. 1, in a view from the front and enlarged compared with FIG. 1.

It can be seen in FIG. 2 that the supporting frame 1 is supported by a pillar 10. The control tires 5 can also be seen from FIG. 2, by means of which the vehicle cabins 4 are moved through the stations. The vehicle cabins 4 are located at the lower end of a supporting bar 41. At the upper end of the supporting bar 41, there is located a coupling device 6 having a roller and having current collectors 7. The current collectors 7 are assigned power rails 8, which are located on a supporting beam 12 protruding downward from the supporting frame 1. Reference is made in this regard to the explanations provided hereinafter in respect of FIG. 3.

The current collectors 7 are produced from a material consisting predominantly of copper and graphite, and the power rails 8 are produced from copper.

Lines 7*a* located on the supporting bar 41 extend from the current collectors 7 to two circuits 90, 90*a* located in the vehicle cabins 4, said circuits being used to supply electrical energy to loads 91*a*, 93*a* located in the vehicle cabins 4.

Figure 4:
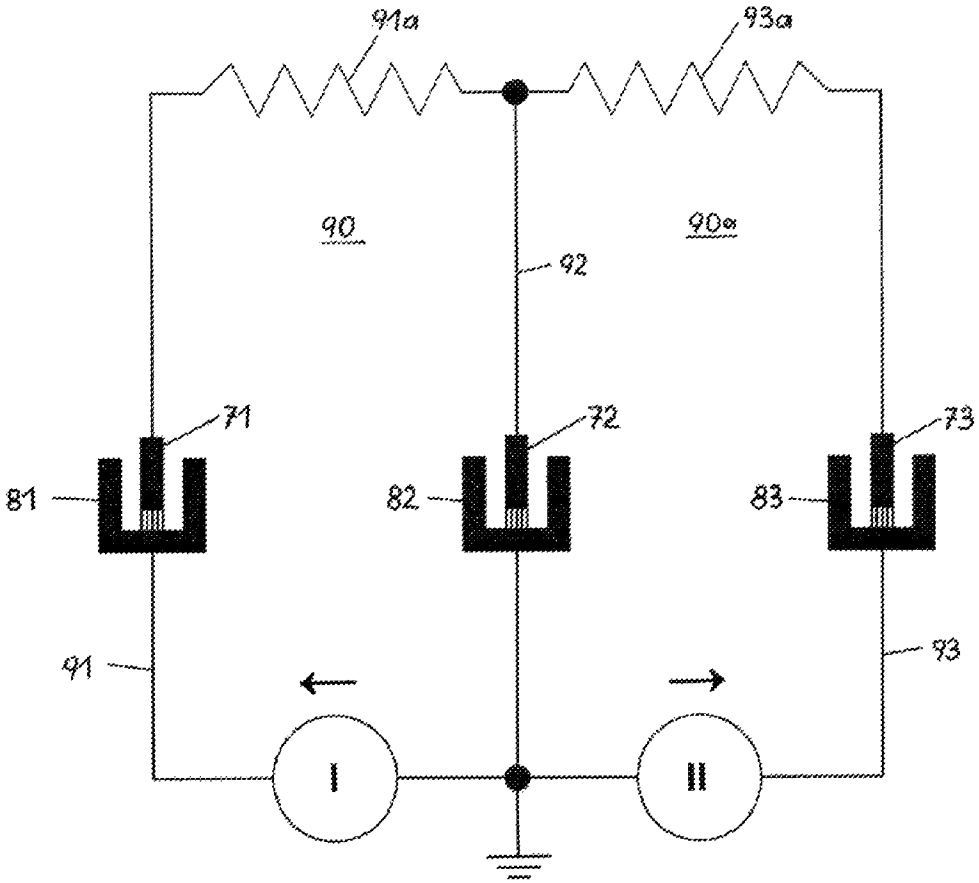
FIG. 4 shows a circuit diagram of two circuits located in the vehicle cabin of a vehicle of the cable car system for supplying collectors located in these two circuits.

Reference is made in this regard to the explanations provided hereinafter in respect of FIG. 4.

Figure 3:
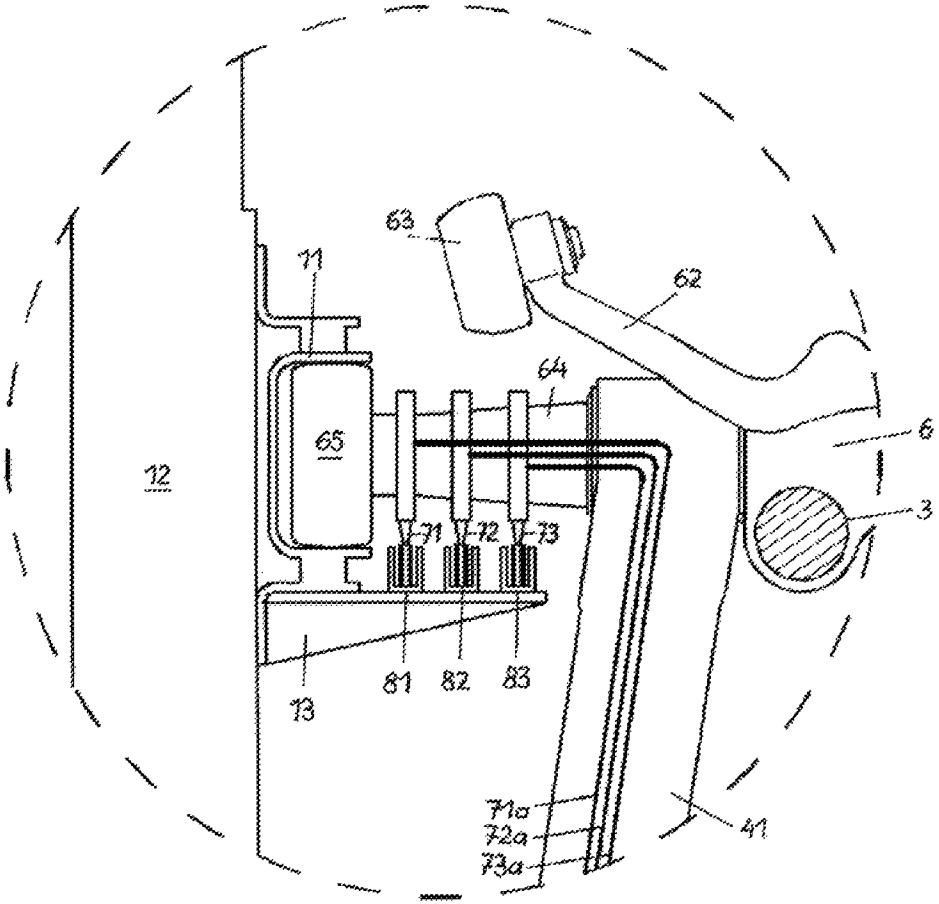
FIG. 3 shows the detail A of FIG. 2, on an enlarged scale by comparison.

As can be seen from FIG. 3, the coupling device 6, which has clamping jaws, is formed with a control lever 62, which is pivotable by a control roller 63. The vehicle cabin 4 can be coupled to the conveying cable 3 by means of the clamping jaws, one of which can be moved relative to the other by the control roller 63. The coupling device 6 is also formed with a supporting pin 64, at the free end of which there is a roller 65 mounted, which can be moved in the guide rail 11 located on the supporting structure 1. There are also three current collectors 71, 72 and 73 located on the supporting pin 64, which are assigned three fixed power rails 81, 82 and 83. The power rails 81, 82 and 83 are secured to a supporting strip 13 protruding transversely from the supporting beam 12. The two circuits 90 and 90*a* located in the vehicle cabin 4 and in which the loads 91*a*, and 93*a* are located are supplied with electrical energy via the power rails 81, 82 and 83 and the current collectors 71, 72 and 73 via lines 71*a*, 72*a* and 73*a*.

Since the current collectors 71, 72 and 73 are located on the supporting pin 64, on which the roller 65 guided in the guide rail 11 is mounted directly beside said current collectors, the current collectors 71, 72 and 73, which are moved through the station with the vehicle cabin 4, are located in stable relative positions opposite the fixed power rails 81, 82 and 83, whereby a largely spark-free conduction of the current to the loads 90 and 90*a* is ensured. Since, however, the minimum sizes of the current collectors 71, 72 and 73 and of the power rails 81, 82 and 83 predefined for transferring the necessary powers may not be undershot, only a small number of current collectors 71, 72 and 73 can be arranged in the space available for this purpose.

As is illustrated in FIG. 2, there are arranged in the vehicle cabin 4 two circuits 90, 90*a*, in which there are located loads 91*a* and 93*a*. As can be seen from FIG. 4, the loads 91*a* and 93*a* are connected to power sources I and II via the current collectors 71 and 73, the power rails 81 and 83, and via lines 91 and 93. The two circuits 90 and 90*a* are also connected to the power rail 82, which is preferably grounded, via a common return line 92 and the current collector 72.

A total of just three current collectors 71, 72 and 73 and power rails 81, 82 and 83 assigned to each other are therefore necessary for the supply of the loads 91*a* and 93*a* located in the two circuits 90 and 90*a*. Just one further current collector and one further power rail assigned thereto are necessary for each further circuit.

The loads in the individual circuits can be supplied with direct current and/or with alternating current. Any voltages and frequencies can be used.

In order to be able to supply current to a seat heater located in a vehicle of a cable car system, in particular in a cable car cabin, very high powers must be transferred within a short time, for example within 25 seconds, as the vehicle travels through the cable car stations. Since there is only a small amount of space available for the arrangement of the current collectors on the coupling device, the current collectors may only have small dimensions, which for example are designed for a continuous output of 50 A. However, since the current transfers occur only in the short term, current with a strength of up to 100 A can be transferred. Due to the direct current, loads can be directly fed in the short term. At least one battery is also provided in the vehicles for a continuous feed.

On account of the very high energy density occurring at the contact faces in the case of a transfer of this type, sparks or arcs occur between the power rails and the current collectors. When direct current is transferred, arcs are moved on in the direction of movement of the current collectors, whereby the power rails and the current collectors are subject to heavy corrosion. Since, by contrast, when alternating current is transferred, arcs that occur are periodically interrupted, corrosion of the power rails or of the current collectors caused as a result is much lower. For this reason, the transfer of alternating current is much more favorable compared with the transfer of direct current. However, it is necessary for a rectifier to be arranged upstream of the at least one battery for the continuous supply of electrical devices located in the vehicles.

An inductive transfer of alternating current therefore does not meet the technical requirements, since only low powers can be transferred hereby.

A seat heater located in a vehicle can be operated for example with an alternating current at 48 V. Here, the seat heater is supplied with current as the vehicle travels through a station, whereby the seat is heated. However, the seat is heated only as the vehicle travels through the station. If, by contrast, a battery is provided, this can be charged as the vehicle travels through the station, whereby the seat heater can also be supplied with electrical energy outside the stations.

In accordance with the present invention, a further circuit is provided in the vehicles, in which circuit there are located electrical or electronic devices and systems, such as those used for entertainment technology, messaging technology, control technology, etc. Devices and systems of this type can be supplied with 24 V direct current. The batteries are supplied for this purpose by means of direct current at, for example, 24 V and 50 A. With such values the risk of the formation of arcs and the resultant corrosion of the power rails or current collectors is relatively low. In accordance with a variant of this type, one of two circuits located in the vehicle is thus supplied with alternating current, whereas the other circuit is supplied with direct current.

The functions of the at least two load circuits supplied with electrical energy separately from one another can be controlled by switching the current feed on and off in the stations. The functions of the electrical or electronic devices located in the vehicles can also be controlled from the stations by means of a transmitting and receiving system.

As is clear from the above explanations, it is very important for a number of reasons to be able to supply electrical energy in the stations to the at least two circuits located in a vehicle of a cable car system by means of current collectors assigned to said circuits. Since there is only a very small amount of space available for this purpose at the coupling devices, it is important that only a single further current collector and one power rail assigned thereto are necessary for each further circuit.

The invention claimed is:

1. A cable car system, comprising:

at least two stations and a conveying cable extending between the stations;

a plurality of vehicles having coupling devices configured for coupling to said conveying cable for movement between said stations, wherein said vehicles are decoupled from said conveying cable in said stations and are moved through said stations along guide rails;

each of said coupling devices having a horizontally extending supporting pin with a free end disposed to support the vehicle on the guide rails in said stations;

a plurality of current collectors mounted on each said supporting pin, said current collectors including at least three current collectors disposed adjacent one another horizontally along said supporting pin; and at least one of said stations having a plurality of power rails to be associated with said current collectors and configured to enable said at least three current collectors to slide therein as the respective vehicle is moved through said at least one of said stations, said power rails including at least three power rails disposed adjacent one another horizontally;

at least one of said vehicles carrying a first circuit with at least one first electrical load to be supplied with electrical energy via a first of said current collectors and a first power rail of said plurality of power rails;

said at least one of said vehicles carrying at least one second circuit with at least one second electrical load to be supplied with electrical energy via a second of said current collectors and a second power rail assigned to said second current collector;

said plurality of current collectors including a common current collector connected to said first and second circuits and having a single power rail of said plurality of power rails assigned thereto.

2. The cable car system according to claim 1, wherein said single power rail assigned to said first and second circuits is electrically grounded.

3. The cable car system according to claim 1, wherein at least one of said circuits is fed with direct current and at least one of said circuits is fed with alternating current.

4. The cable car system according to claim 3, which comprises at least one battery disposed in at least one of said circuits.

5. The cable car system according to claim 4, wherein said at least one battery is arranged downstream of a rectifier that is located in said at least one circuit that is fed with alternating current.

6. The cable car system according to claim 1, wherein said plurality of current collectors mounted on each said supporting pin are exactly three current collectors and said power rails are exactly three power rails fixedly mounted in said stations.

7. The cable car system according to claim 1, which comprises a carrying roller rotatably mounted to said free end of said supporting pin and disposed for rolling in said guide rails in said stations.

* * * * *